US011407556B1

(12) United States Patent
Mathia

(10) Patent No.: US 11,407,556 B1
(45) Date of Patent: Aug. 9, 2022

(54) COMBINATION GIFT CRATE AND COIN BANK

(71) Applicant: Ted Mathia, Stow, OH (US)

(72) Inventor: Ted Mathia, Stow, OH (US)

( * ) Notice: Subject to any disclaimer, the term of this patent is extended or adjusted under 35 U.S.C. 154(b) by 0 days.

(21) Appl. No.: 15/872,946

(22) Filed: Jan. 16, 2018

(51) Int. Cl.

| | |
|---|---|
| ***B65D 6/02*** | (2006.01) |
| ***B65D 5/42*** | (2006.01) |
| ***A45C 1/12*** | (2006.01) |
| *B65D 85/34* | (2006.01) |

(52) U.S. Cl.
CPC ..... *B65D 9/06* (2013.01); *A45C 1/12* (2013.01); *B65D 5/4212* (2013.01); *B65D 85/34* (2013.01)

(58) Field of Classification Search
CPC .. A45C 1/12; A45C 11/00; B65D 9/06; B65D 5/4212; B65D 85/34; G07F 9/06; G07F 1/02; E05G 1/005; E05G 1/024; E05G 1/026; G07D 11/009
USPC ..... 232/4 R; 446/8; 217/36, 17, 56, 65, 217/12 R; 206/0.815
See application file for complete search history.

(56) References Cited

U.S. PATENT DOCUMENTS 2,351,387 A * 6/1944 Anderson ..... B65D 11/06 217/72
2,401,065 A * 5/1946 Gonzalez ..... A45C 1/12 232/4 R
2,501,694 A * 3/1950 Ruffin ..... A45C 11/00 229/116.1
3,104,024 A * 9/1963 Eberly ..... B65D 9/16 217/12 R
3,993,242 A * 11/1976 Guy ..... A47G 1/0616 446/8
4,967,953 A * 11/1990 Sugawara ..... A45C 11/00 217/11
7,347,356 B2 * 3/2008 Fields ..... A45C 1/02 206/0.81
D708,414 S * 7/2014 Chen ..... D99/38
10,080,410 B2 * 9/2018 Holzkenner ..... A45C 15/00
D847,454 S * 4/2019 Mathia ..... D99/37
2011/0290870 A1 * 12/2011 Ramsaroop ..... A45C 1/12 232/5
2012/0244776 A1 * 9/2012 Burns ..... A45C 1/12 446/8

* cited by examiner

*Primary Examiner* — William L Miller
(74) *Attorney, Agent, or Firm* — Gugliotta & Gugliotta LPA

(57) ABSTRACT

A gift packaging container is provided further adapted for a secondary use function as a coin piggy bank. A hollow volume formed of solid planar surfaces forms and circumscribes a container volume adapted to receive and retain gift contents in a manner that seals them within the volume by a resealable top lid. The lid further forms an entry orifice that is covered and sealed by an access plate. The access plate forms a coin slot capable of receiving currency coins for access into the container volume. The entire gift packaging container/piggy bank combination may be a crate formed of wood. A least one outer surface further has a visibly accessible advertising or marketing indicia. The instant abstract is neither intended to define the invention disclosed in this specification nor intended to limit the scope of the invention in any way.

7 Claims, 8 Drawing Sheets

COMBINATION GIFT CRATE AND COIN BANK

RELATED APPLICATIONS

There are no previously filed, nor currently any co-pending applications, anywhere in the world.

BACKGROUND OF THE INVENTION

1. Field of the Invention

The present invention relates generally to both wooden packaging crates and to banks and, and, more particularly, to a combination of these two disparate products.

2. Description of the Related Art

A gift basket, or fruit basket, is a traditional gift delivered to the recipient at their home or workplace for various occasions. A variety of gift baskets exist: some contain fruit; while others might contain dry or canned foods such as tea, crackers and jam; or the basket might include a combination of fruit and dried good items. Further, the basket can be of wicker or various other materials. Gourmet gift baskets typically include exotic fruit, and often include quality cheese and wine, as well as other non-food items.

Gift baskets are often sent for special occasions such as for holidays or as a thank you gift or congratulations gift. Recently, variations have developed on gift basket themes. One such variation is a fruit bouquet, an arrangement of fruit in the form of bouquet with the fruit cut in the shape of flowers and leaves and arranged in a container with the help of sticks. One type of arrangement that looks like a bouquet of flowers is provided by Edible Arrangements®, a company from Wallingford, Conn. that franchises such retail locations worldwide.

Another type of gift-basket alternative or variation includes the "gift crate", in which a more masculine wooden crate structure is used to store and deliver a gift basket's contents or a thematic variation of such contents. Once such source can be found online at http://www.mancrates.com, operated by Launchpad Inc. of San Mateo, Calif. that provides various self described "man's theme" contents within a semi-industrial looking wooden gift box.

With the proliferation of such gift concepts, it has been found that the novelty effect of such gifts and promotions creates a positive recipient experience, so much so that the packaging, i.e. the wooden crate, is often saved as a souvenir. The retention of such physical articles by those who have had a positive recipient experience creates a tremendous opportunity for referrals and for continued and positive brand awareness.

In a separate light, a "piggy bank" has become a generic name for a coin container. The piggy bank has a long history since is the early 20th century, and is often sought by collectors if including mechanical arrangements, but can also be used by children for saving change or used by companies for promotional purposes. The use of the name 'piggy bank' gave rise to its widely recognized 'pig' shape, and many financial services companies use piggy banks as logos for their savings products. The latter examples are often made de of ceramic or porcelain and serve as a pedagogical device to teach the rudiments of thrift and savings to children in that money can be easily inserted but more difficult to retrieve, with some designs not having an extraction opening which results in the smashing of the piggy bank with a hammer or by other means to obtain the money within.

Some methods and devices are known that incorporate various mechanisms and structures that can function as either a coin bank or a packaging crate within their capabilities. For example, on directing the search for the specific combination, any significant prior art that has been detected includes the following.

U.S. Patent No. 522,538, issued in the name of Taylor, discloses a shipping crate that includes horizontally disposed side slats that provides increased strength with a reduced overall bulk and weight.

U.S. Patent Publication No. 2010/0313529, published in the name of Steinhauser, discloses a collapsing box that provides a lidded container which coordinates visually with the item contained therein by providing one or more sides that collapse and open to allow visual access to the gift contained therein.

U.S. Pat. No. 8,478,661, issued in the name of Kressler, discloses a system for purchasing and delivering a specific gift in which the buyer is provided with a gift proxy within a special package with includes a gift token which allows for authentication of ownership of the gift.

U.S. Pat. No. 9,373,139, also issued in the name of Kressler, is a related application to the above and includes claims drawn around the method of operating the system for purchasing and delivering a specific gift (the 'method of use' rather than to the elements of the system itself, i.e. 'apparatus').

And, U.S. Pat. No. 9,624,014, issued in the name of Marsh, discloses a gift box with special affects that describes a gift box that contains various electronic components to provide sound, movement, light or other special effect that are triggered upon opening of the box.

It is preferable that in conjunction with the use of novelty gift crate devise that a ancillary function be found to allow a continued secondary use of the packaging material once the contents are gone. Consequently, a need has been felt for providing combination wooden gift crate that can convert to a secondary functionality as a coin piggy bank.

SUMMARY OF THE INVENTION

It is thus an object of the present invention to provide a novelty or promotional wooden packaging crate for delivery of gift contents that may continue to have a subsequent, secondary and different functionality.

It is a feature of the present invention to provide a wooden gift packaging crates that functions alternately as a coin bank.

The present invention provides a novelty or promotional wooden packaging crate adapted for delivery of gift contents. A gift packaging container is provided further adapted for a secondary use function as a coin piggy bank. A hollow volume formed of solid planar surfaces forms and circumscribes a container volume adapted to receive and retain gift contents in a manner that seals them within the volume by a resealable top lid. The lid further forms an entry orifice that is covered and sealed by an access plate. The access plate forms a coin slot capable of receiving currency coins for access into the container volume. The entire gift packaging container/piggy bank combination may be a crate formed of wood. A least one outer surface further has a visibly accessible advertising or marketing indicia.

It is an advantage of the present invention to provide an aesthetically designed wooden gift crate that can be used for delivery of various and sundry gift contents.

It is another advantage of the present invention to provide such a durable gift packaging that includes one or more fascia capable of supporting an advertising or marketing indicia.

It is yet another advantage of the present invention to provide such a durable gift packaging that can have a subsequent, secondary and different functionality.

It is still a further advantage of the present invention to have different functionality be as a coin bank.

Further objects, features, elements and advantages of the present invention will become readily apparent from the following detailed description of the preferred embodiment when considered with the attached drawings and the appended claims.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
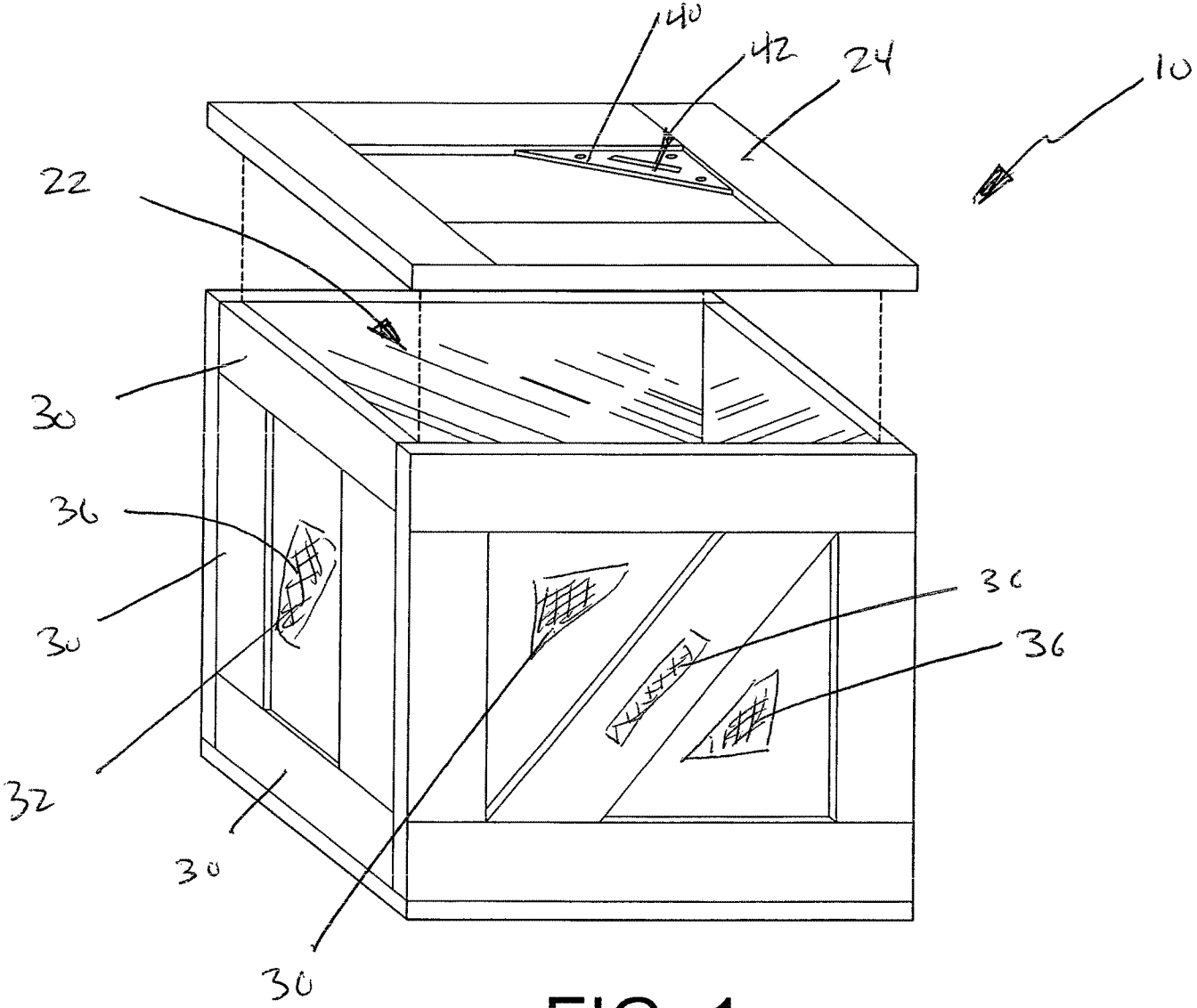
FIG. 1 is a partially exploded front perspective view of a gift crate and coin bank combination according to the preferred embodiment of the present invention.
Figure 2:
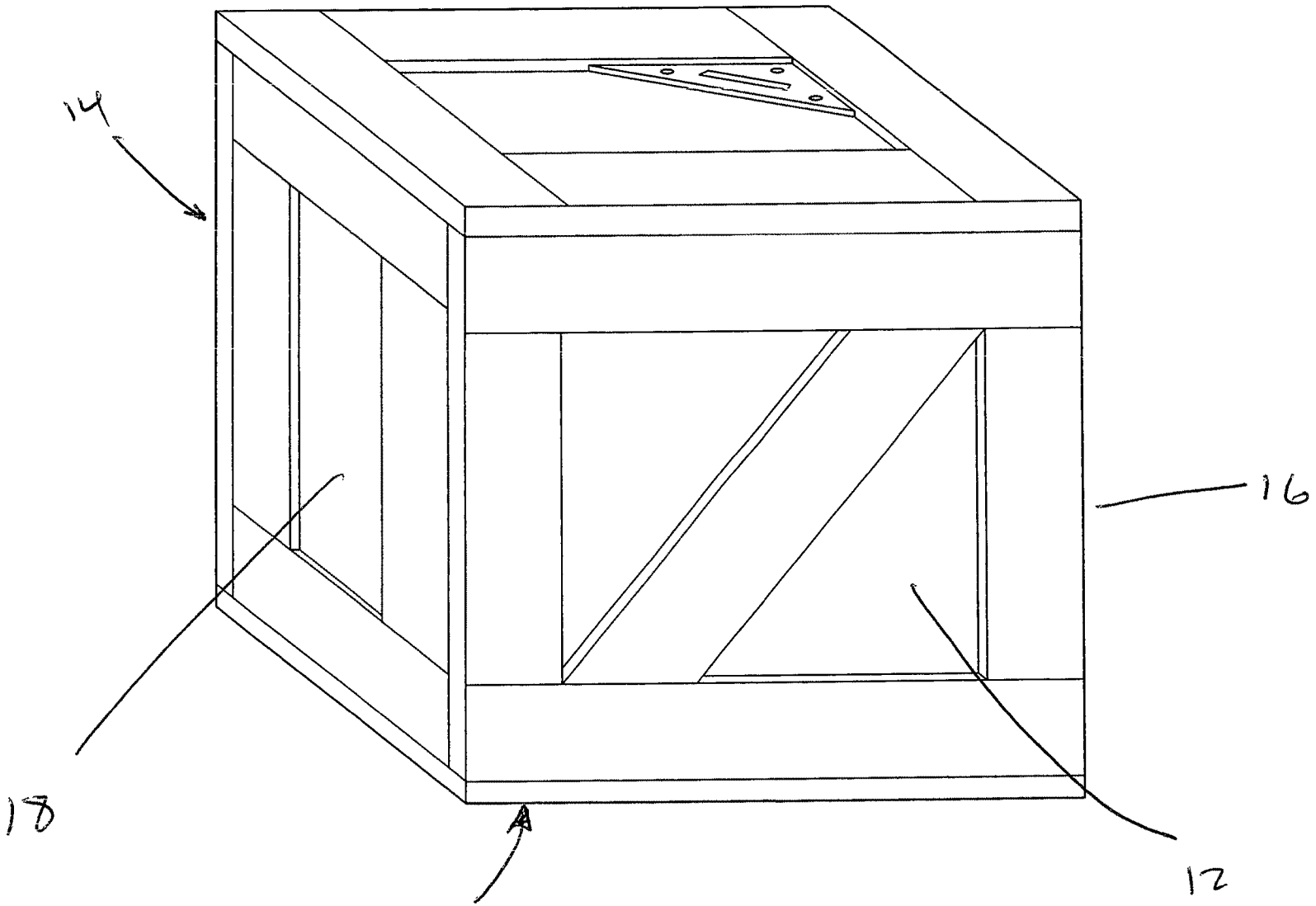
FIG. 2 is a front perspective view thereof.
Figure 3:
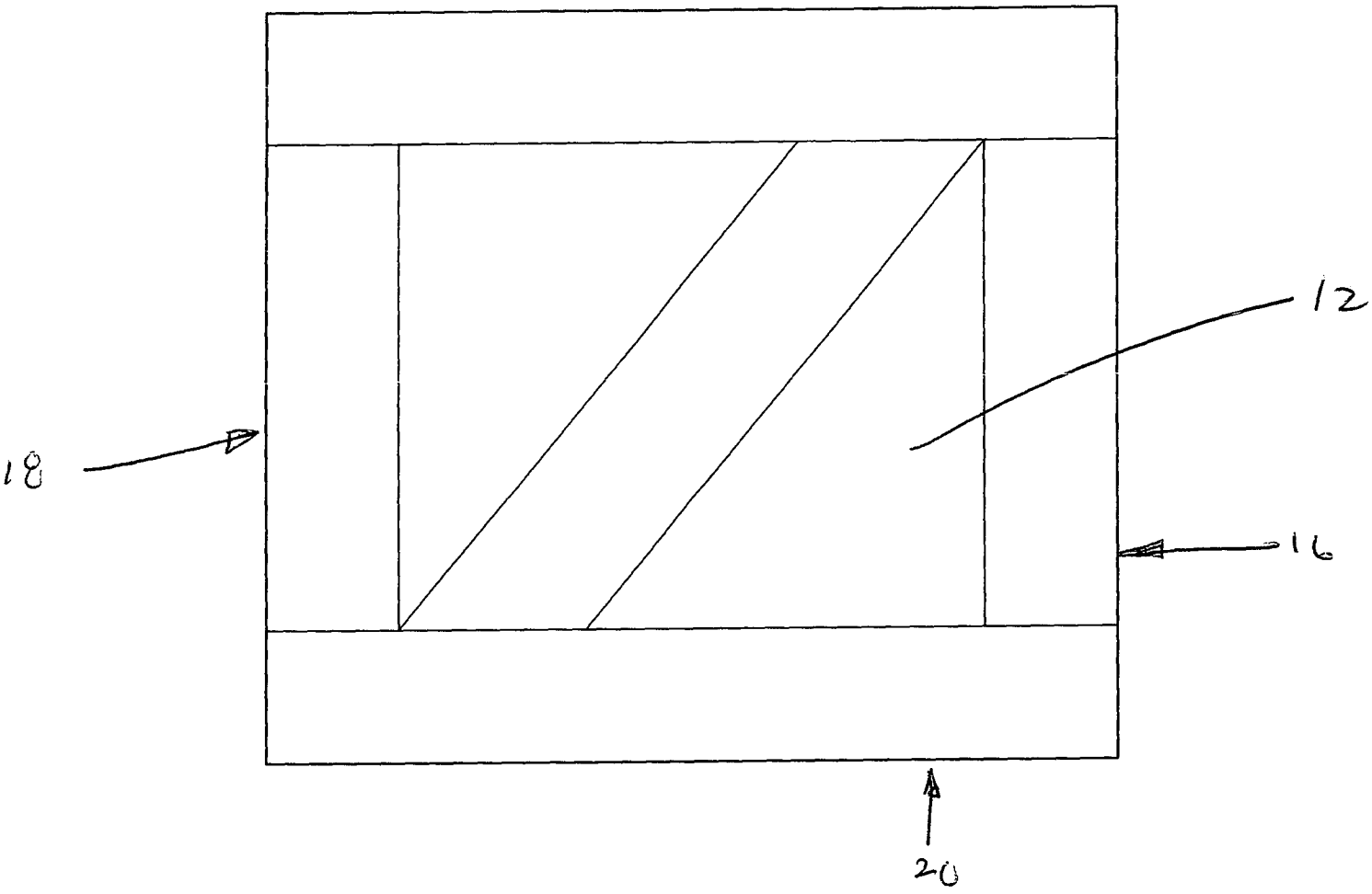
FIG. 3 is a front elevational view thereof.
Figure 4:
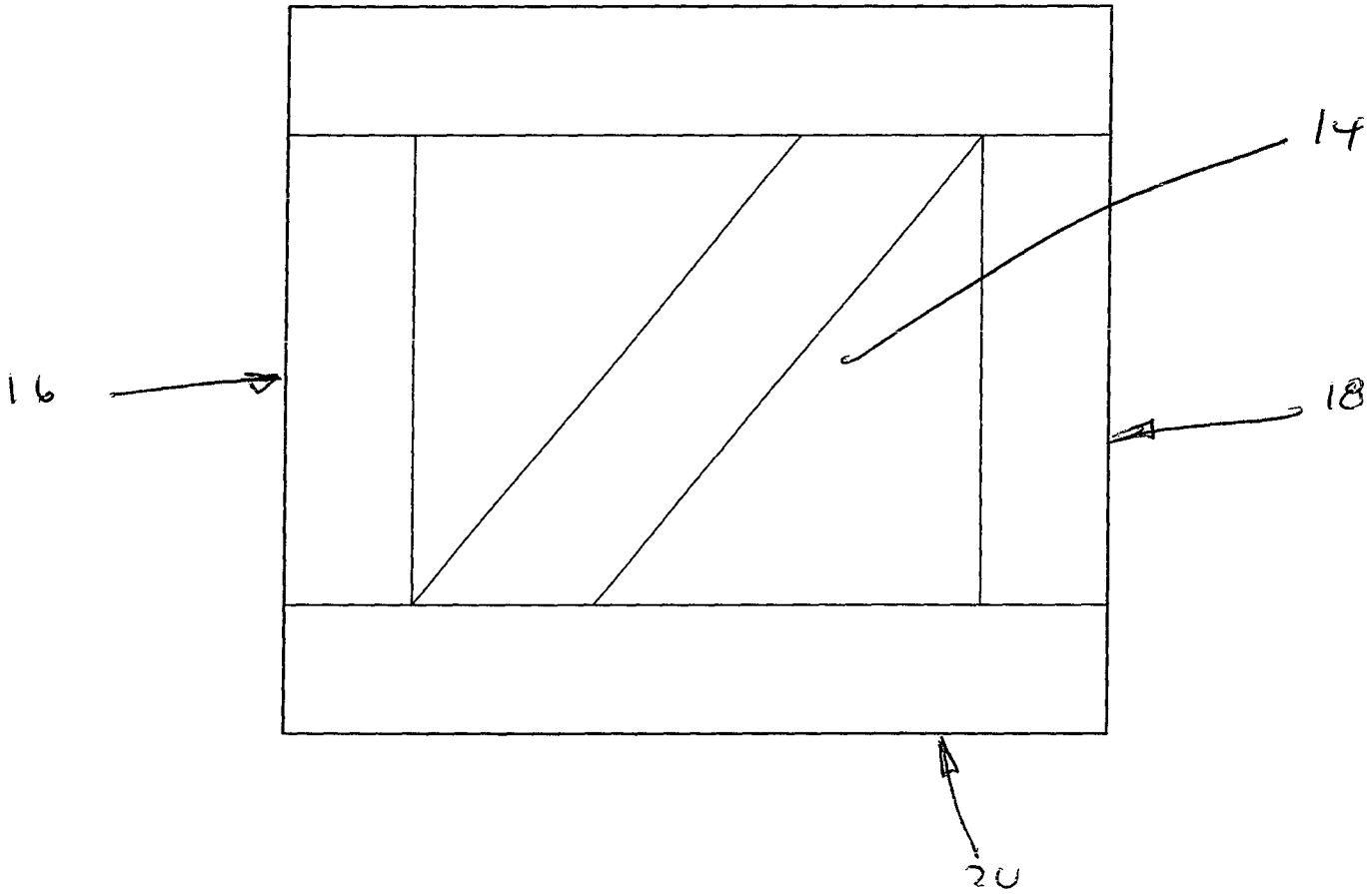
FIG. 4 is a rear elevational view thereof.
Figure 5:
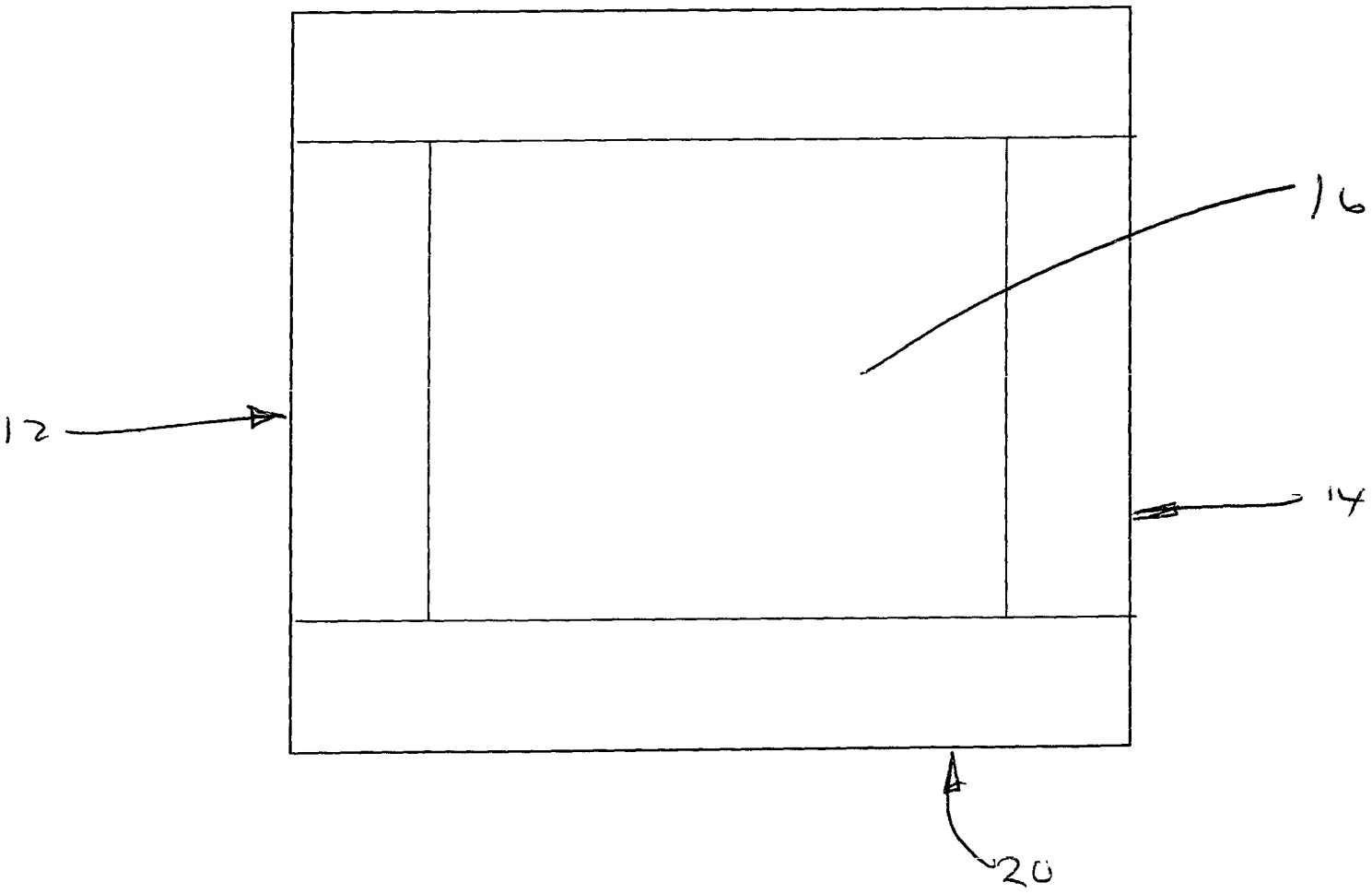
FIG. 5 is a left side elevational view thereof.
Figure 6:
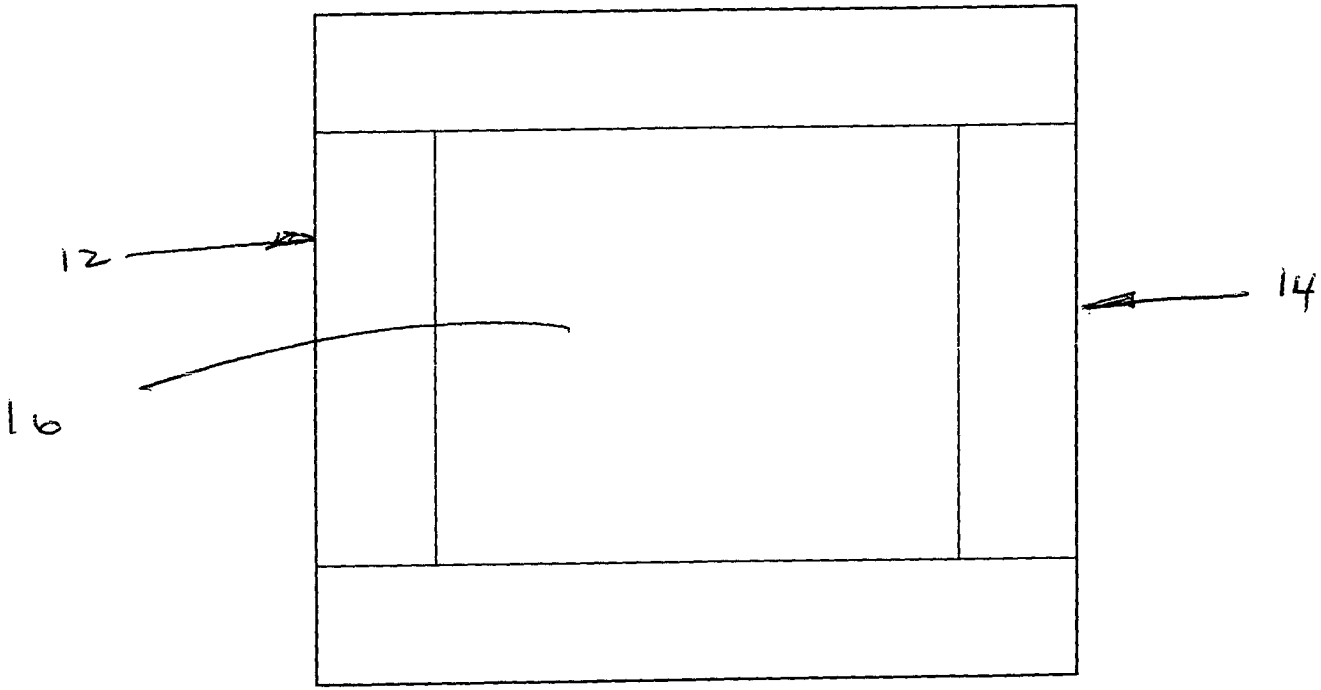
FIG. 6 is a right side elevational view thereof.
Figure 7:
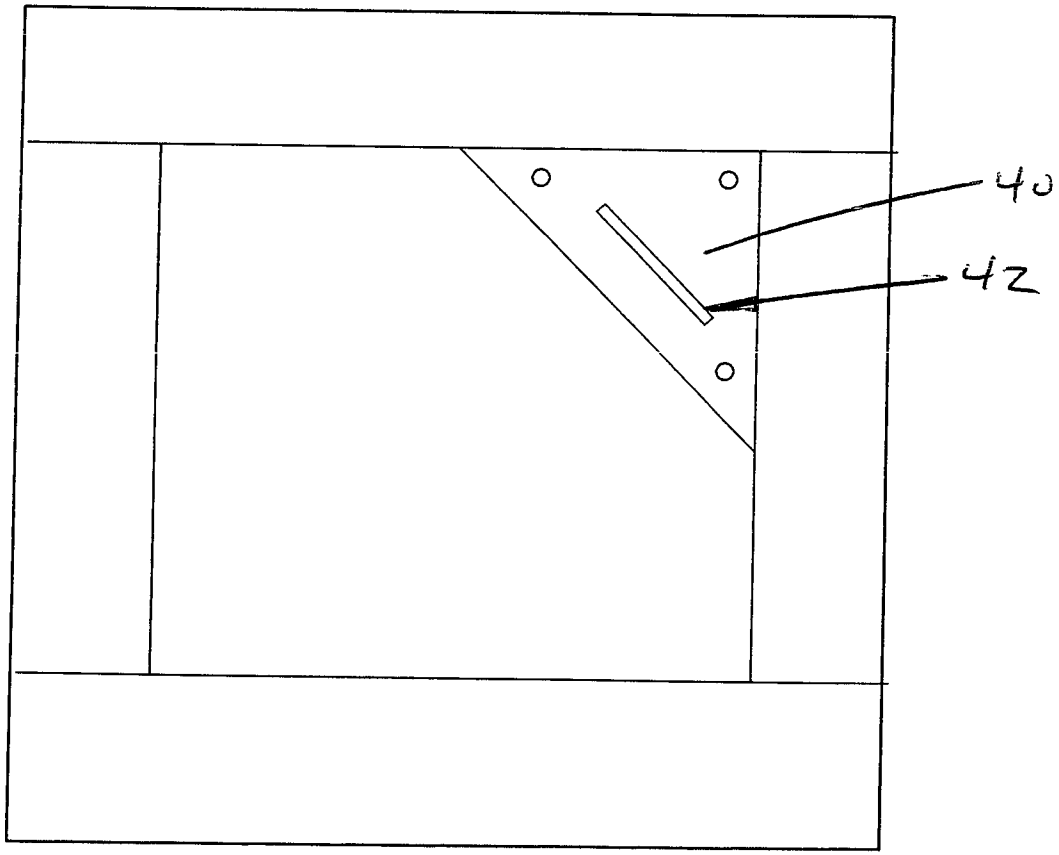
FIG. 7 is a top plan view thereof.
Figure 8:
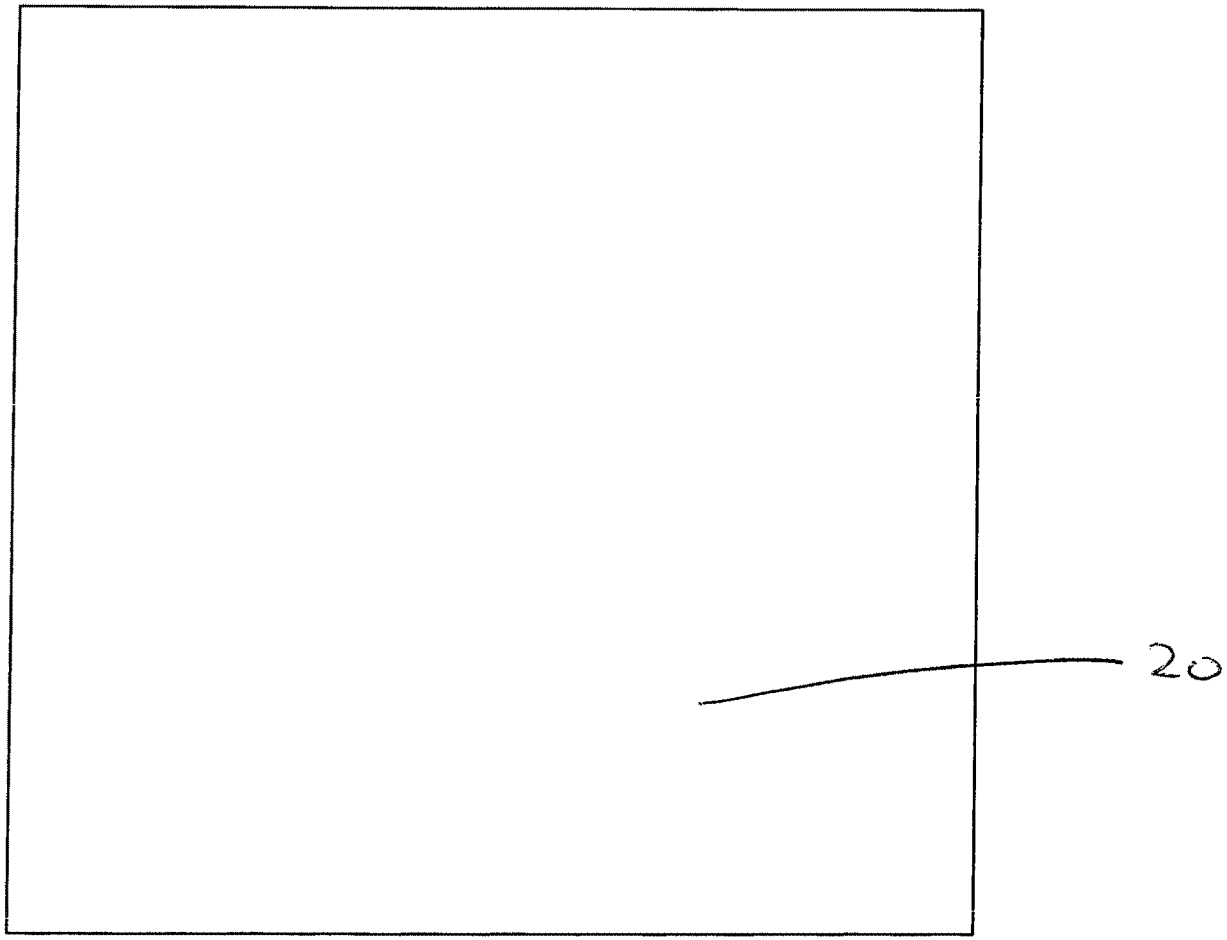
FIG. 8 is a bottom plan view thereof.

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

The best mode for carrying out the invention is presented in terms of its preferred embodiment, herein depicted within the Figures.

1. Detailed Description of the Figures

Referring now to the drawings, wherein like reference numerals indicate the same parts throughout the several views, a gift crate packaging, generally noted as 10, is shown according to the preferred embodiment of the present invention. The gift crate 10 may be constructed of wood and provided with a novelty or promotional aesthetic adapted for delivery of gift contents. The crate 10 has a front face 12, a rear face 14, a left side face 16, a right side face 18, and a bottom face 20.

The front face 12, rear face 14, left side face 16, and right side face 18 are each secured to a respective outer edge of the bottom face 20 in a manner that forms and circumscribes a container volume 22. The container volume 22 is intended to receive and retain gift contents in a manner that seals them within the volume 22 by a resealable top lid 24. One or more of each of the faces may be formed of a plurality of wooden slats 30 in a manner that forms a solid planar surface. According to one aspect of the present invention, one or more planar surfaces may comprise a recessed inner surface 32 circumscribed by wooden slats 30 forming a perimeter framing to the inner surface 32. According to another aspect of the present invention, an additional diagonal reinforcement slat 34 may span diagonally across an inner surface 32 bifurcating it into a pair of coordinated triangular surfaces 34.

With the gift crate 10 being so formed as durable gift packaging may be provided. It is further intended that the wooden crate 10, after terminating its packaging function, may often be saved as a souvenir. As such, it is intended that one or more advertising or marketing indicia 36 may be provided on one or more recessed inner surface 32, one or more diagonal reinforcement slat 34, or on any triangular surfaces 34.

Finally, the resealable top lid 24 further forms an entry orifice (not shown) that is covered and sealed by an access plate 40. The access plate 40 further forms a coin slot 42 capable of receiving currency coins for access into the volume 22.

2. Operation of the Preferred Embodiment

In operation, the wooden crate 10 is intended to be used as a gift packaging and container of a type that may be saved as a souvenir. The placement of one or more advertising or marketing indicia 36 on the retained souvenir 10 may further create an opportunity for referrals and for continued and positive brand awareness. Further, by removing the lid 12, emptying any gift contents (not shown), and replacing the lid 12, the crate 10 can subsequently be converted to a continued secondary use once the contents are gone such as to improve the opportunity to retain the crate 10 such as to allow for further visual access to the advertising or marketing indicia 36. By providing such continued secondary functionality as a coin piggy bank, long term visual access of the indica 36 may be provided.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but is to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

Having thus described the invention what is claimed as new and desired to be secured by Letters Patent is as follows:

1. In combination:

a gift crate packaging container adapted to provide storage for and delivery of gift contents; and a coin piggy bank, wherein said coin piggy bank has a secondary use function of a gift box and wherein said gift crate packaging container further comprises:

a front face forming a first solid planar surface;

a rear face forming a second solid planar surface;

a left side face forming a third solid planar surface;

a right side face forming a fourth solid planar surface;

a bottom face having four intersecting outer edges and forming a fifth solid planar surface;

said front face, rear face, left side face and right side face each being secured to a respective outer edge of the bottom face in a manner that forms and circumscribes a container volume adapted to receive and retain gift contents in a manner that seals them within the volume by a resealable top lid, said top lid forming a sixth solid planar surface;

said resealable top lid further forms an entry orifice that is covered and sealed by an access plate; and said access plate forms a coin slot capable of receiving currency coins for access into the container volume.

2. The combination of claim 1, wherein said gift crate packaging container is formed of wood.

3. The combination of claim 1, wherein at least one said solid planar surface further comprises a visibly accessible advertising or marketing indicia.

4. The combination of claim 2, wherein at least one said solid planar surface further comprises a visibly accessible advertising or marketing indicia.

5. The combination of claim 1, wherein at least one said face or said lid comprises:

a recessed inner surface circumscribed by wooden slats forming a perimeter framing to the inner surface.

6. The combination of claim 5, further comprising:

a diagonal reinforcement slat spanning diagonally across the recessed inner surface.

7. A gift packaging container comprising a crate formed of wood and further comprising:

a front face forming a first solid planar surface;

a rear face forming a second solid planar surface;

a left side face forming a third solid planar surface;

a right side face forming a fourth solid planar surface;

a bottom face having four intersecting outer edges and forming a fifth solid planar surface;

said front face, rear face, left side face and right side face each being secured to a respective outer edge of the bottom face in a manner that forms and circumscribes a container volume adapted to receive and retain gift contents in a manner that seals them within the volume by a resealable top lid, said top lid forming a sixth solid planar surface;

said resealable top lid further forms an entry orifice that is covered and sealed by an access plate; and said access plate forms a coin slot capable of receiving currency coins for access into the container volume; and a diagonal reinforcement slat spanning diagonally across a recessed inner surface;

wherein said gift packaging container is further adapted for a secondary use function as a coin piggy bank and wherein at least one of said first solid planar surface, said second solid planar surface, said third solid planar surface, or said fourth solid planar surface further comprises a visibly accessible advertising or marketing indicia; and wherein at least one said face or said lid comprises:

the recessed inner surface circumscribed by wooden slats forming a perimeter framing to the inner surface.

* * * * *